US005651486A

United States Patent [19]

Kliot

[11] Patent Number: 5,651,486

[45] **Date of Patent: *Jul. 29, 1997**

[54] BACK PACK FOR HEAVY BULKY FOOTWEAR

[75] Inventor: Eugene Kliot, New York, N.Y.

[73] Assignee: Visual Impact Films Corporation, New York, N.Y.

[ * ] Notice: The term of this patent shall not extend beyond the expiration date of Pat. No. 5,509,589.

[21] Appl. No.: 500,515

[22] Filed: Jul. 11, 1995

Related U.S. Application Data

[63] Continuation-in-part of Ser. No. 255,669, Jun. 9, 1994, Pat. No. 5,509,589.

[51] Int. Cl.[6] ..... A45F 3/04

[52] U.S. Cl. ..... 224/653; 224/657

[58] Field of Search ..... 224/204, 205, 224/208, 209, 210, 211, 213, 215, 216

[56] References Cited

U.S. PATENT DOCUMENTS

| | | | |
|---|---|---|---|
| D. 312,726 | 12/1990 | Kline | D3/217 |
| D. 367,173 | 2/1996 | Tribus . | |
| D. 369,021 | 4/1996 | Kliot | D3/217 |
| 2,672,263 | 3/1954 | Alber . | |
| 4,096,978 | 6/1978 | Noice . | |
| 4,126,256 | 11/1978 | McGruder | 224/205 X |
| 4,883,207 | 11/1989 | McArthur . | |
| 4,982,883 | 1/1991 | Ullal et al. | 224/209 |
| 5,158,220 | 10/1992 | Glass | 224/209 |

FOREIGN PATENT DOCUMENTS 3323763 1/1985 Germany .

*Primary Examiner*—Renee S. Luebke
*Attorney, Agent, or Firm*—Hughes Hubbard & Reed LLP

[57] ABSTRACT

A backpack for carrying bulky, heavy footwear such as inline skates, conventional roller skates, ice skates or ski boots is provided. Preferably, a backpack for carrying inline skates is provided. According to the invention, the backpack includes a left and right opposed footwear compartments. The left and right compartments are angularly joined together at the front base portion of the compartments to form an isosceles triangle therebetween. The joined right and left compartments define a portion of the front face of the backpack. The compartments have a sufficient height for receipt of the blade portion of a skate and/or of the top portion of a bulky boot, for example, a ski boot. In addition, the compartments have a sufficient depth to receive the blade portion of a skate. An improvement is presented in which the footwear compartments are L-shaped and nested such that the ankle-receiving potion of one compartment is situated above the ankle receiving portion of the other compartment.

14 Claims, 6 Drawing Sheets

38
40
22
10
22
3
32
38
34
44
40
14
12
14
3
30
16
12

BACK PACK FOR HEAVY BULKY FOOTWEAR

This application is a continuation-in-part of Ser. No. 08/255,669, now U.S. Pat. No. 5,509,589, filed Jun. 9, 1994 and is related to U.S. Pat. No. 369,021.

BACKGROUND OF THE INVENTION

1. Field of the Invention

The field of the invention is backpacks for carrying heavy footwear such as in-line skates or ski boots.

2. Description of the Prior Art

There are numerous backpacks on the market. These backpacks may be used to carry sporting equipment and the like. However, heavy, bulky footwear, such as inline roller skates, conventional roller skates, ice skates, and ski boots are particularly difficult to accommodate in a standard backpack. The footwear either does not fit or shifts around in the bag. As a result, prior art backpacks have proved unsatisfactory for transporting heavy, bulky footwear.

Carriers for ice skates and roller skates and the like are known, for example, U.S. Pat. Nos. 4,126,256 and 2,672,263 show the use of L-shaped compartments for carrying roller skates or ice skates. Ski boot bags having a triangular shape are known. See Design U.S. Pat. No. 312,726. Backpacks having side compartments are also known in the art. See, U.S. Pat. No. 4,096,978 (Noice). However, there still is a need for a versatile backpack that can accommodate inline roller skates or other bulky footwear.

SUMMARY OF THE INVENTION

A backpack for carrying bulky, heavy footwear such as inline skates, conventional roller skates, ice skates, ski boots or riding boots is provided. Preferably a backpack for carrying inline roller skates is provided.

According to the invention, the backpack includes left and right opposed footwear compartments. These compartments have a generally polygonal side face, preferably a trapezoidal or pentagonal side face, a generally rectangular back face and a narrow width. The left and right footwear compartments are angularly joined together at the front base portion of the compartments to form an isosceles triangle therebetween. The joined right and left footwear compartments define a portion of the front face Of the backpack. A piece of luggage material such as tight weave nylon is used to complete the front of the backpack by closing off the top of the area between the left and right footwear compartments. The left and right footwear compartments are rather narrow on the front face and in fact are only wide enough to receive the narrow part of a boot or skate. This prevents shifting of the footwear when carried. The narrow width of the footwear compartments contributes to the efficient use of the space and limits the bulk of the bag. The compartments have a sufficient height for receipt of the blade portion of a skate and/or of the top portion of a bulky boot, for example, a ski boot. In addition, the compartments have a sufficient depth to receive the blade portion of a skate. As a result the compartments can efficiently accommodate bulky footwear such as boots for example, ski boots and riding boots or skates for example, inline skates, ice skates or conventional roller skates with a minimal amount of wasted space.

In an alternative embodiment, the opposed footwear compartments are L-shaped and nested such that the ankle-receiving portion of one compartment is situated above the ankle receiving portion of the other compartment.

The backpack has been ergonomically designed to transport heavy footwear preferably boots or skates in a compact back pack which is easy and comfortable to carry. The angularly connected footwear compartments enclose the boot or skate in a minimum amount of space while at the same time directing the weight of the footwear toward the side to evenly distribute the weight across the back of the user. In addition, according to the invention when the backpack is used with blade skates, the blade portion of a skate is directed away from the user to prevent accidental injury if the user is pushed or jarred from behind. An interior compartment is also provided for carrying sport accessories.

It is an object of the invention to provide a backpack for bulky, heavy footwear which can be comfortably carried.

It is an object of the invention to provide a backpack for bulky, heavy footwear which will evenly distribute the weight of the footwear across the back of the user.

It is an object of the invention to provide a backpack for comfortably carrying a pair of inline roller skates and a helmet.

It is an object of the invention to provide a backpack for blade skates which directs the blades away from the back of the user while distributing the weight of the load across the user's back.

It is an object of the invention to provide a compact backpack for carrying blade skates which will prevent the skates from shifting in the backpack.

Other and further objects will become apparent from the present specification.

The preferred embodiment of the present invention is illustrated in the drawings and examples. However, it should be expressly understood that the present invention should not be limited solely to the illustrative embodiment.

DETAILED DESCRIPTION OF THE INVENTION

According to the invention a backpack carrying bulky footwear is provided. The backpack provides a means to carry heavy footwear such as ski boots, riding boots, blade skates such as inline roller skates and ice skates, conventional roller skates, and the like in a compact package. Most preferably a backpack for carrying inline roller skates is provided. The backpack according to the invention can be easily and comfortably carried by the user without having the blades of blade skates uncomfortably and dangerously stick into the user's back and without the footwear shifting around in the backpack.

According to the invention, two opposed footwear compartments are provided. The footwear compartments have a narrow width to snugly engage the footwear, e.g., inline skates, and prevent shifting and/or movement of the footwear when carried. The footwear compartments are angularly joined at their front base to form the front of the bag and to direct the weight in the compartments outwardly toward the sides of the user. As a result, a compact backpack for transporting bulky footwear which occupies a limited amount of space is provided. The weight of the footwear carried in the backpack is evenly distributed across the back of the user. In another aspect of the invention, an interior compartment is provided between the opposed footwear compartments for carrying sports accessories such as sports helmets and pads or cold weather gear such as hats, goggles, scarves and gloves.

Figure 1:
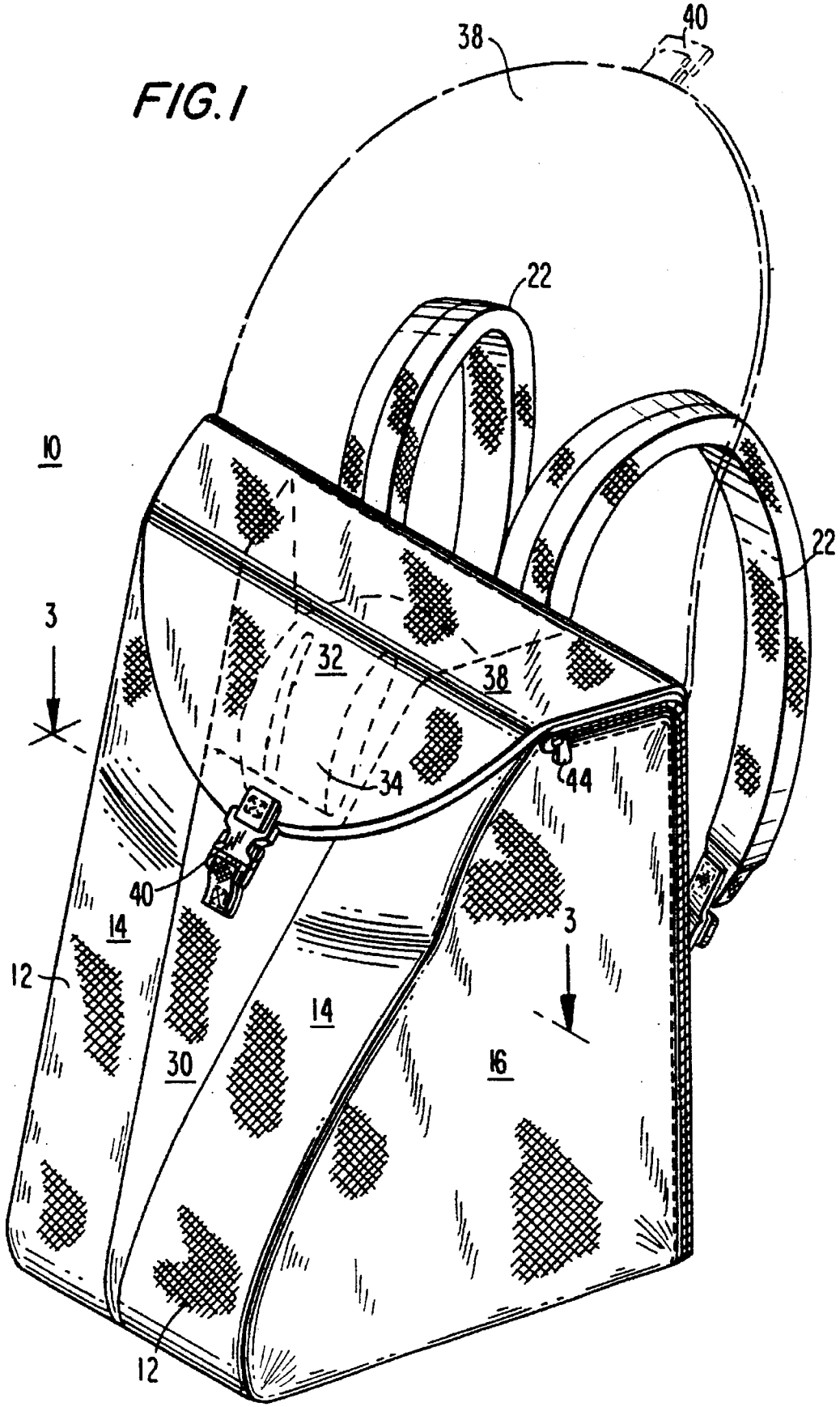
FIG. 1 is a perspective view of the backpack according to the invention.
Figure 2:
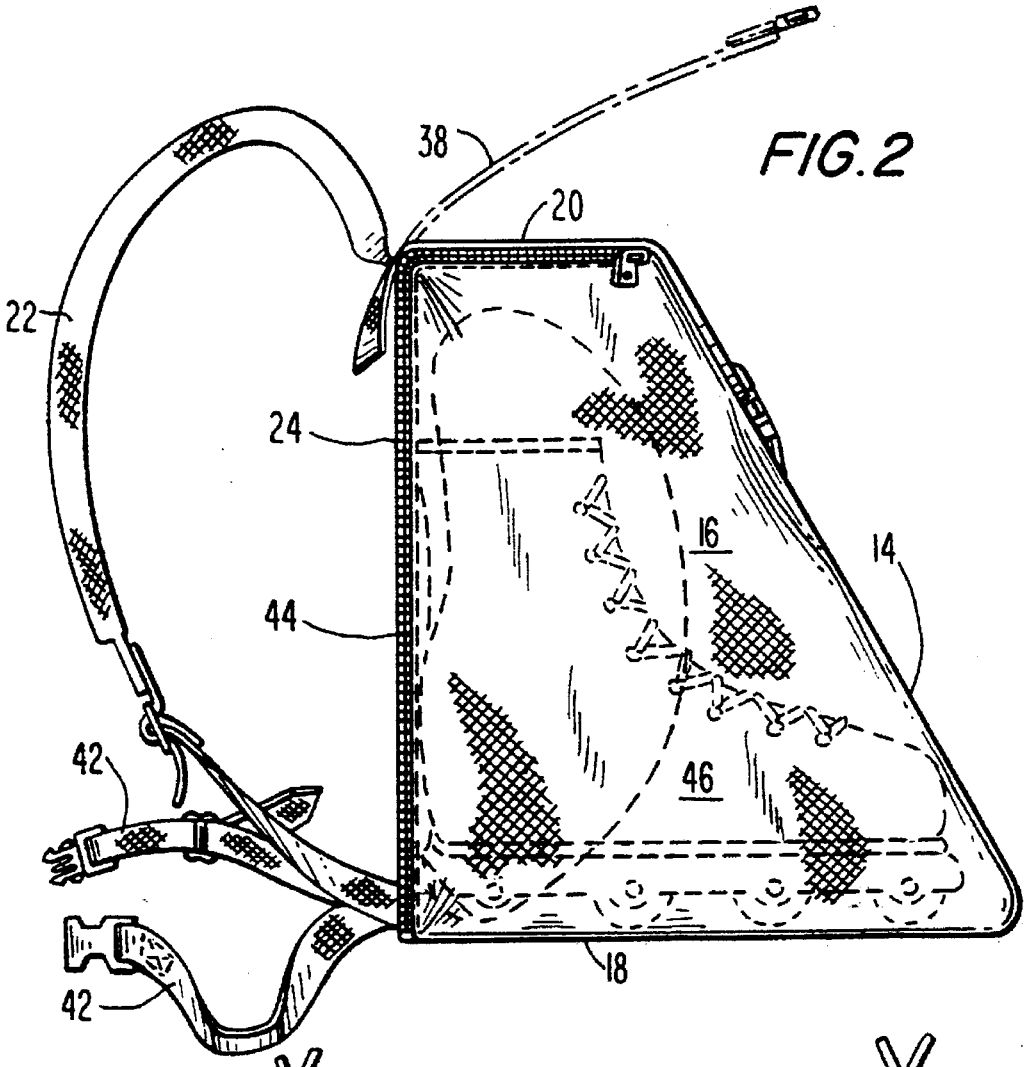
FIG. 2 is a side view of the backpack of FIG. 1 with an inline skate in place.
Figure 5:
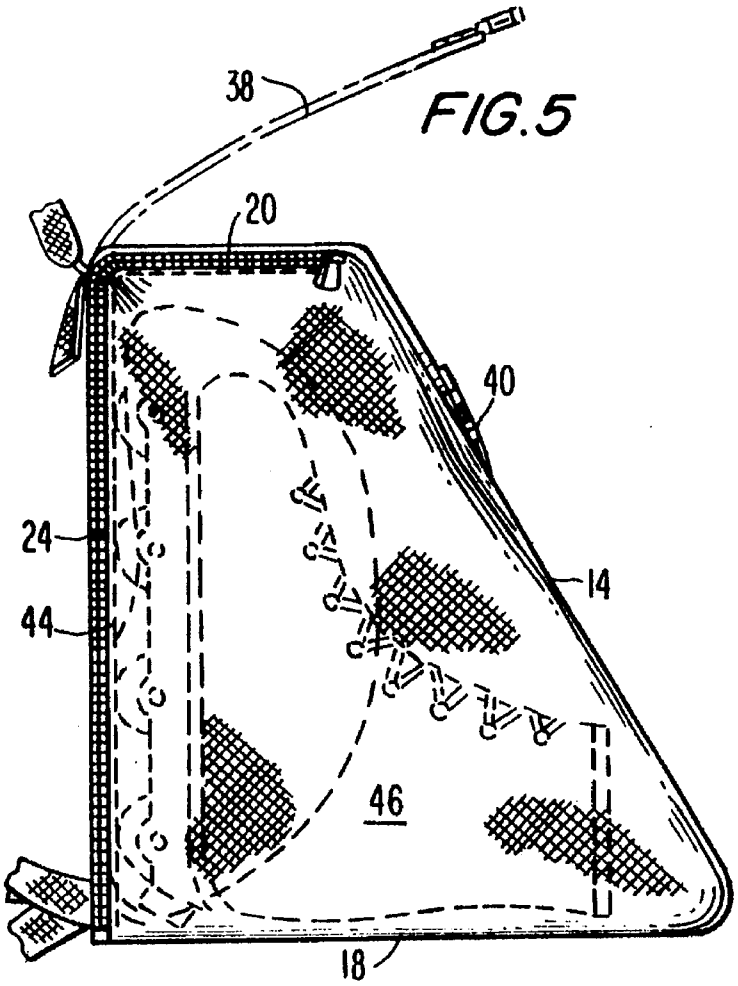
FIG. 5 is a side view of the backpack of FIG. 1 with an inline skate in an alternate location to that shown in FIG. 2.
Figure 4:
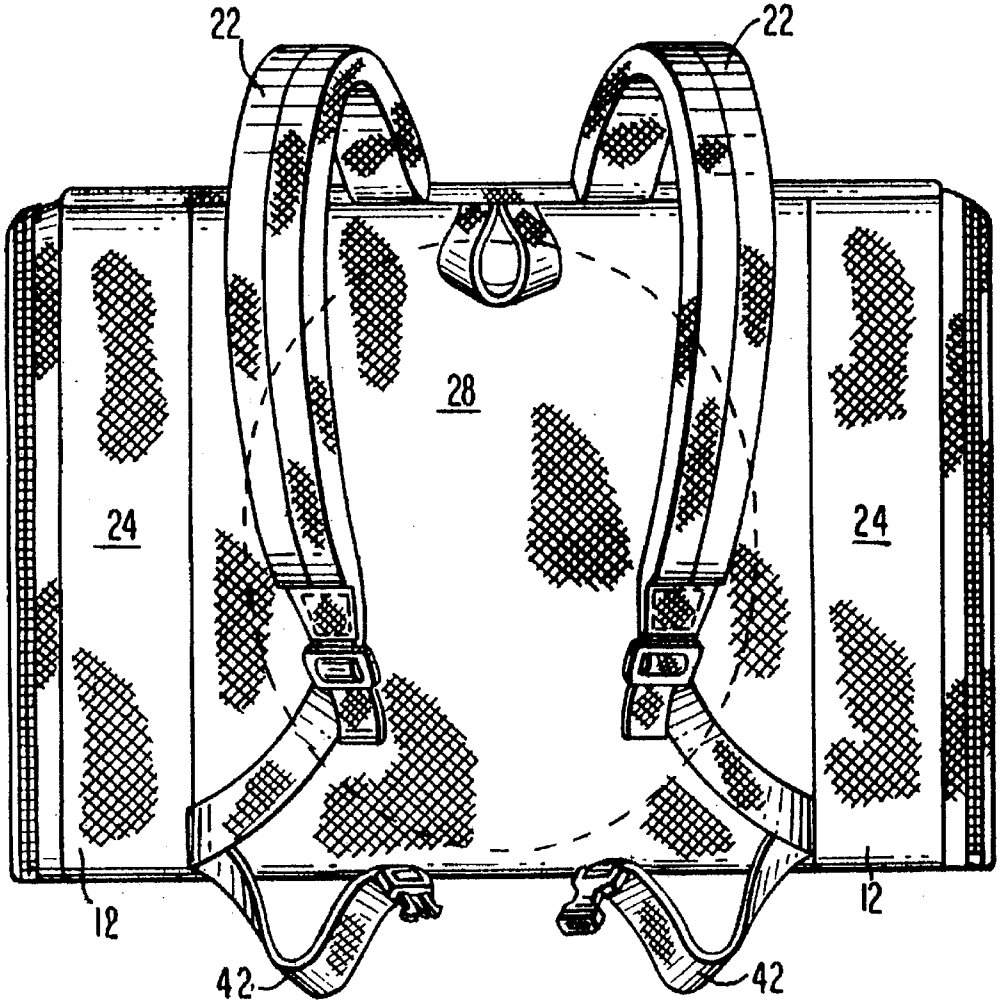
FIG. 4 is a rear view of the backpack according to the invention.
Figure 6:
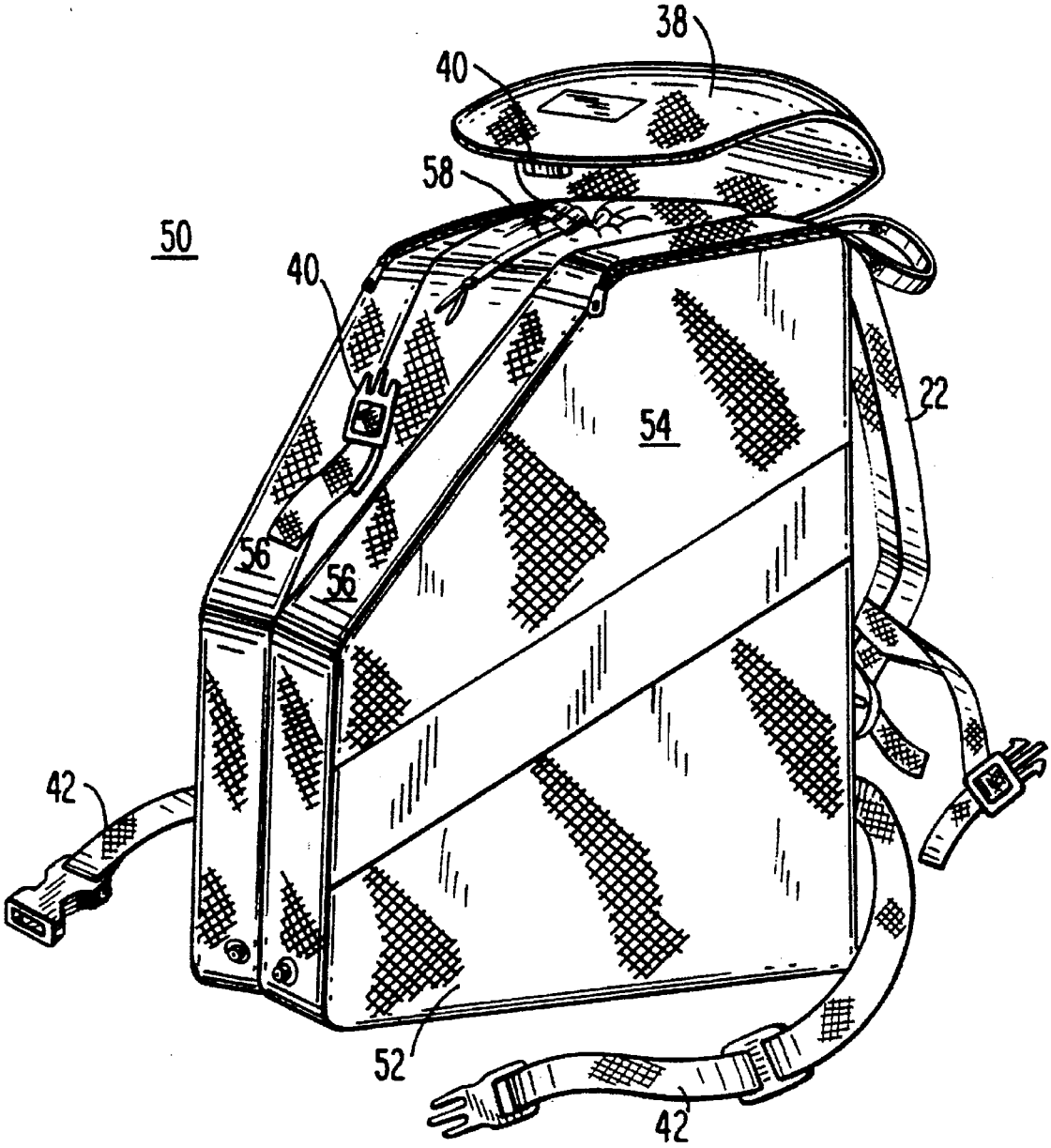
FIG. 6 is a perspective view of an alternate embodiment of the backpack according to the invention.
Figure 7:
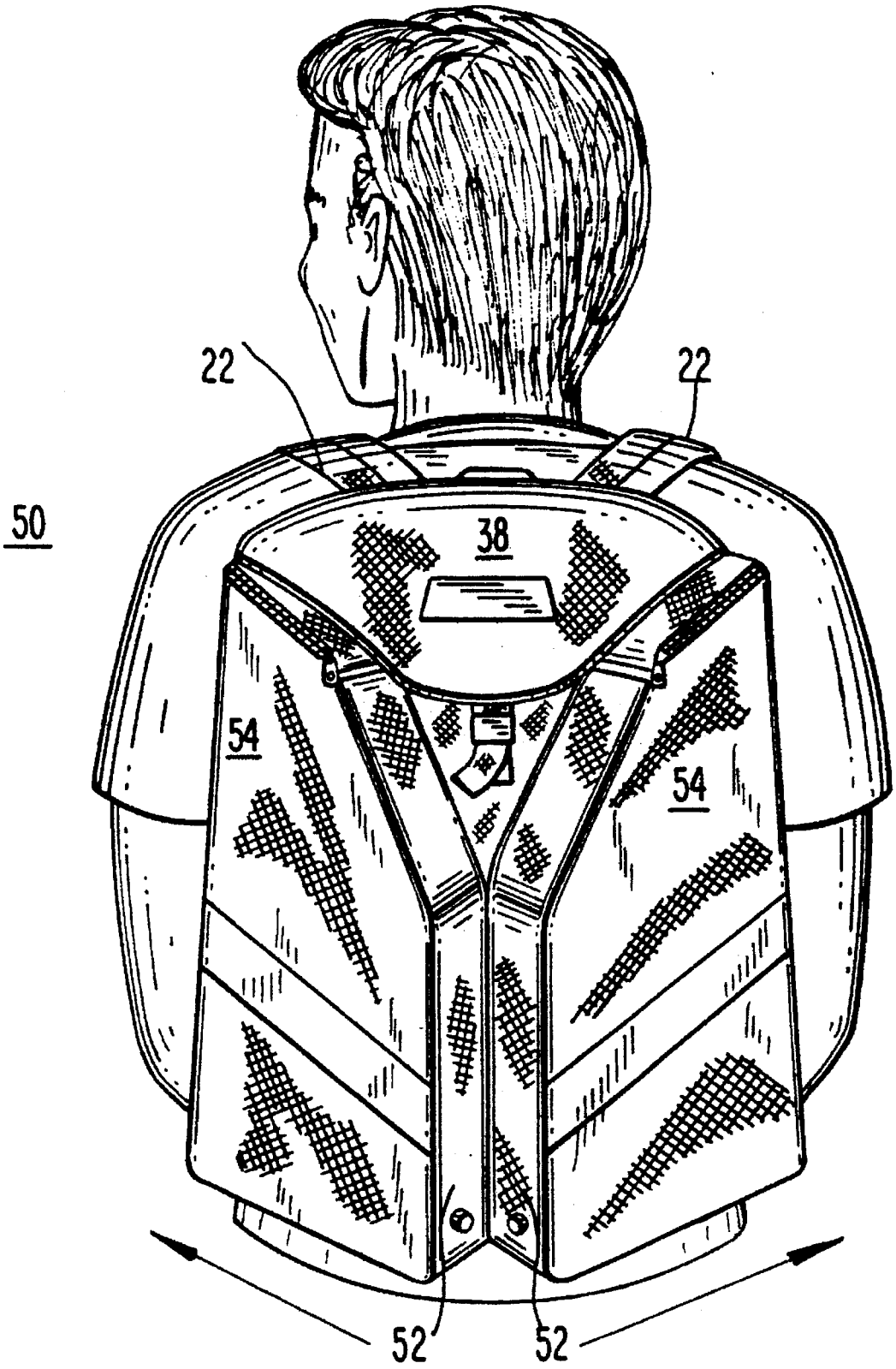
FIG. 7 is a perspective view looking from the front of FIG. 6.

Referring to FIGS. 1 to 5, according to the invention a backpack 10 is provided for carrying heavy bulky footwear. The backpack includes opposed footwear compartments 12. Compartments 12 are composed of polygonal side walls preferably trapezoidal walls 16 which are separated by back wall 24. Alternatively side walls 16 may desirably be pentagonally shaped as shown in FIGS. 6 and 7. The space between side walls 16 is narrow and is only sufficiently wide to accommodate the heel portion of the bulky footwear. Narrow front walls 14 are preferably approximately the width of a normal blade skate or ski boot. Desirably front walls 14 are about the width of the body of a normal skate or boot and may even be slightly less to obtain a snug fit. Optionally the width may be up to two times the width of the normal boot or skate. Side walls 16 are identical on either side of the footwear compartments 12. Referring to FIGS. 2 and 5, side walls 16 are desirably longer at the bottom than at the top. Preferably the top 20 of side wall 16 is from one half to two thirds the size of bottom 18 of side wall 16. Front wall 14 is sloped and interconnects the side walls 16. Vertical back wall 24 is perpendicular to side walls 16 and interconnects side walls 16 at the back.

Figure 3:
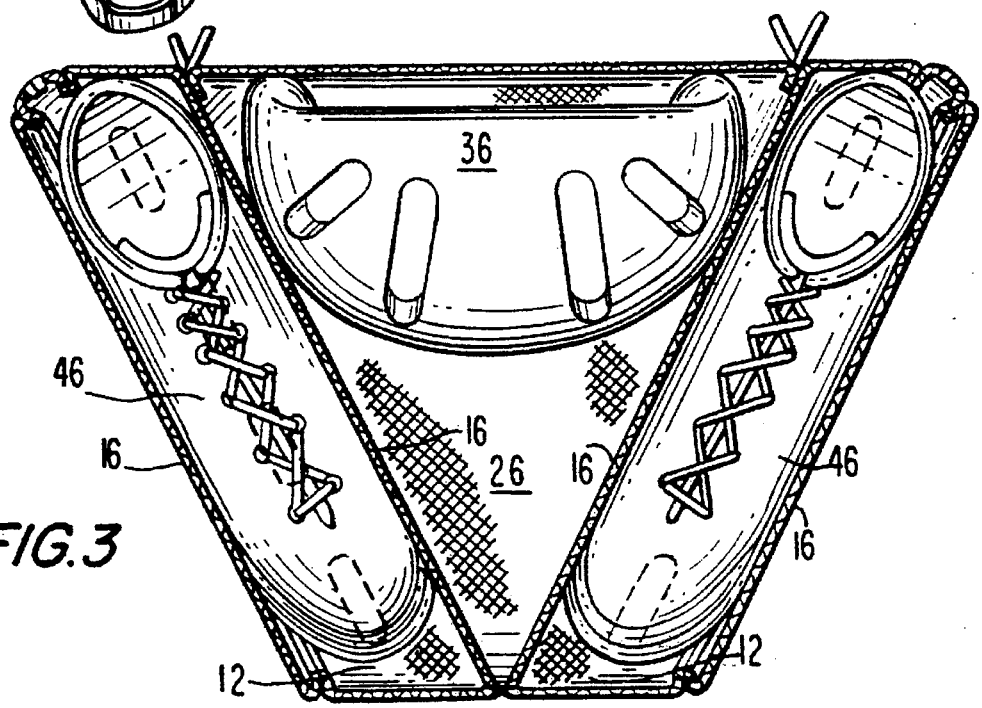
FIG. 3 is a sectional view through 3—3 of FIG. 1.

The backpack 10 is formed by connecting opposed footwear compartments 12 to form the left and right side of the backpack 10. The footwear compartments 12 are angularly joined together at the front base thereof preferably by sewing the compartments 12 to form a compartment therebetween preferably in the shape of an isosceles triangle. Desirably the triangle formed therebetween is an equilateral triangle. The angle $\alpha$ formed between the angularly joined footwear compartments 12 is from 30° to 90° preferably from 45° to 75° and most preferably about 60°. When the angle $\alpha$ is 60°, an equilateral triangle is formed between the angled footwear compartments 12. As best seen in FIG. 1 and FIG. 3, the interior compartment 34 is formed between the angularly joined footwear compartments 12 and triangular floor 26 which is sewn or otherwise attached to the bottom of footwear compartments 12. Backpack back wall 28 interconnects the rear of the angularly spaced footwear compartments 12 to complete the rear of backpack 10. Shoulder straps 22 are attached to the backpack back wall 28 for carrying the backpack 10. The front of the bag is completed by front wall extension 30 which is sewn to the front 14 of footwear compartments 12 to close off the interior compartment 34 from the outside. The interior compartment 34 has an opening 32 at the top to allow loading of athletic accessories. Preferably the interior compartment is generally triangular and is of sufficient size so that a sporting helmet 36 can be carried in the interior compartment 34. Optionally other sporting equipment can be carried either in conjunction with the helmet 36 or instead of the helmet. For example, when the bag 10 is used for inline roller skating, knee, wrist and elbow pads can be carried. Optionally if the bag 10 is used for ski boots, winter wear accessories can be carried in the compartment 34 for example, gloves, scarves and hats. A cover 38 is hingedly attached to the top of backpack 10 to close off opening 32. Preferably the cover 38 is held in place through interlocking connector 40. Optionally a VELCRO™ hook and loop connector system can be used. Desirably a lumbar belt support system 42 is provided so that the bag 10 can be secured around the user's waist. Footwear compartments 12 include zipper closure system 44 which allow opening of compartment 12 along the top 20 and the vertical back wall 24, however, other closure mechanisms can be contemplated, such as snaps or VELCRO™ hook and loop closures. The backpack can be made out of a variety of materials that are suitable for softsided luggage. Preferably the backpack is made out of heavy tight weave nylon most preferably, nylon codura or nylon pack cloth.

Referring now to FIGS. 6 and 7 which show an alternative embodiment of the backpack according the invention. The same parts as shown in FIGS. 1 through 5 are referred to by the same reference numerals. The backpack 50 of FIGS. 6 and 7 has polygonal footwear compartments, preferably pentazoidal shaped footwear compartments 52 having pentazoidal shaped side walls 54 and sloping front walls 56. As shown in FIG. 6 the footwear compartments are sewn together a greater distance at the front base thereof than the embodiment of FIGS. 1 through 5. As shown in FIG. 7, in use the weight of the footwear is directed as shown by the arrows. As shown in FIG. 6 optionally a drawstring closure 58 is provided to close off the interior compartment of the bag.

In use, one each of a pair of heavy footwear preferably an inline skate 46 is placed in each of the footwear compartments 12. There are two preferred configurations for the skates. As shown in FIG. 2, the skate can be placed in the compartment so that the blade extends horizontally along the side of the bag 10. In this configuration the blade of the skate 46 will be directed away from the back of the user and hence, any jarring during carrying of the bag will not result in any discomfort or injury due to the blade imbedding in the user's back. Optionally as shown in FIG. 5 the blade skate 46 may be inserted into the bag so that the blade extends vertically toward the back of the bag 10. In such an embodiment the ankle portion of skate 46 will point toward the front of the bag. Again the blade of the skate will be directed away from the back of the user by the angularly joined footwear compartments 12. In the case of carrying blade skates, the blade, which digs into the user's back in a normal backpack, is directed by the angled footwear compartments away from the back of the user. When ski boots are used, it is generally preferred that the portion of the boot be placed in the horizontal direction in the footwear compartments 12 and the boot portion extend in the vertical direction and rest against the back of the angularly joined footwear compartments. Since the side walls 16 are narrowly spaced apart, the boot or skate is held securely in the compartment without shifting. The resulting backpack is compact and can be used to easily transport heavy footwear preferably inline roller skates, conventional roller skates, ice skates, ski boots and riding boots most preferably inline roller skates. The weight of the bag is evenly and uniformly distributed across the back of the user. The symmetrically aligned angularly connected footwear compartments point any skate blade away from the back of the user and thus minimize the likelihood of injury or discomfort due to the lodging of the blade into the back of the user. Moreover, the arrangement minimizes the space required to carry the skates or other footwear and allows for a roomy inside compartment which can be used to carry other sporting equipment which will usually be associated with the heavy footwear.

Figure 8:
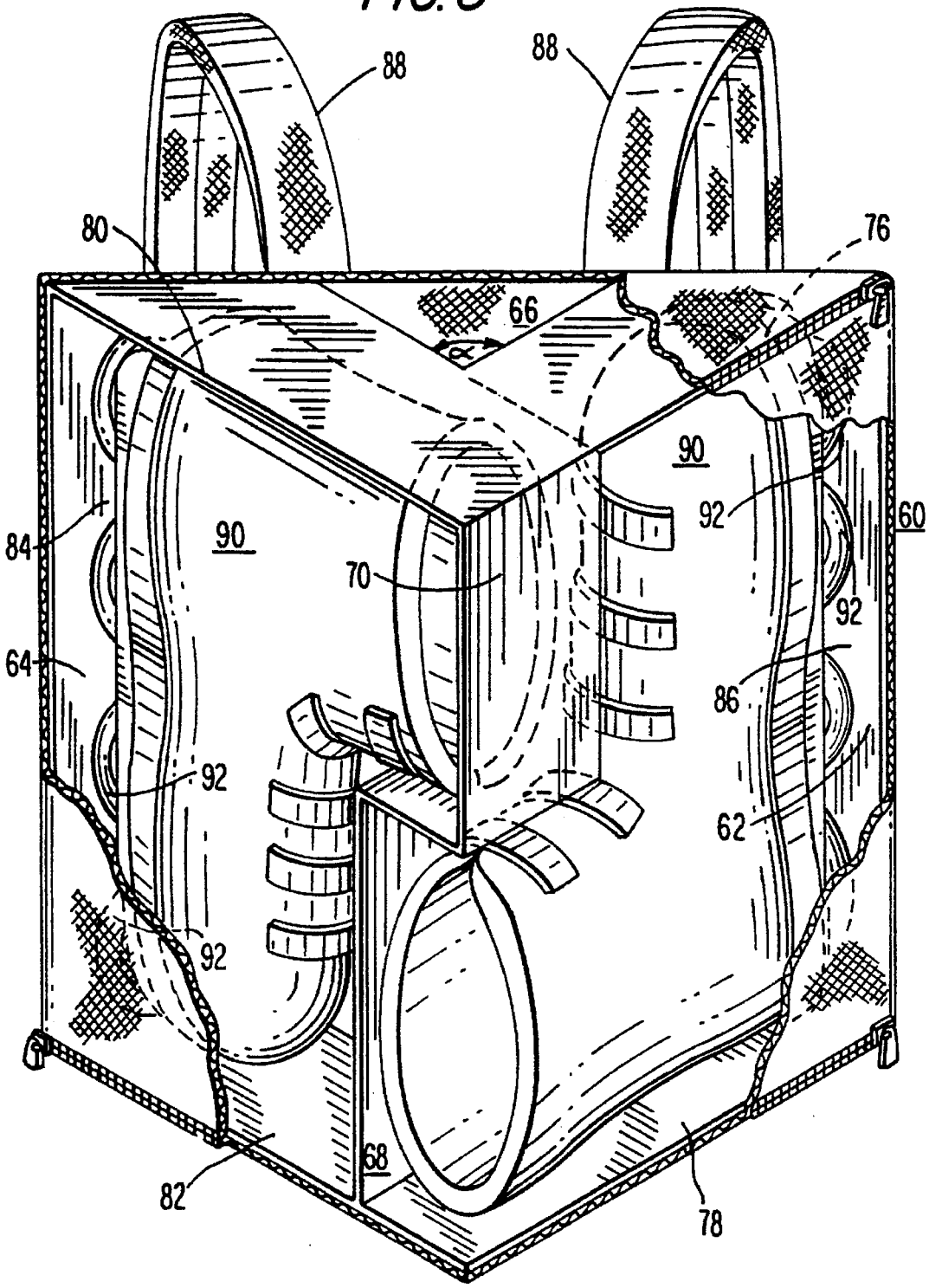
FIG. 8 is a perspective view of an alternate embodiment of the backpack according to the invention.

In another embodiment of the invention, nested footwear compartments are provided. As best seen in FIG. 8, a back pack 60 having nested footwear compartments 62 and 64 is provided. According to the invention, first footwear compartment 62 and second footwear compartment 64, are adapted to receive heavy bulky footwear such as in-line skates, ice skates, ski boots or the like. The back walls 84 and 86 of footwear compartments 64 and 62 have a sufficient height to receive the sole of a heavy bulky footwear. As shown in FIG. 8, the compartments 62 and 64 have a sufficient height to receive the long blade portion 92 of a blade skate 90 along the back walls 84 and 86 of footwear compartments 62 and 64. Alternatively, compartments 62 and 64 are sized to receive the sole portion of the ski boot or of other heavy bulky footwear. Compartment 62 has bottom wall 78 having a length which is longer than the length of the top wall 76. Preferably, the length of bottom wall 78 is twice the length of top wall 76. As a result, L-shaped footwear compartment 62 is formed. The bottom of compartment 62 is sized to receive the ankle portion of a heavy bulky footwear, such as the ankle portion of a blade skate 90 as shown in FIG. 8 or alternatively the ankle portion of the ski boot or other heavy bulky footwear. As a result, the bottom portion of compartment 62 forms ankle receiving compartment 68, which comprises one leg of L-shaped compartment 62.

A second footwear compartment 64 is provided. Footwear compartment 64 has top wall 80 which is longer than bottom wall 82 of compartment 64. Preferably, top wall 80 is twice as long as bottom wall 82. Similar to compartment 62, an L-shaped compartment 64 is formed. However, compartment 64 is longer at the top than at the bottom. A second ankle receiving compartment 70 is formed at the top of compartment 64. The compartments 62 and 64 are angularly joined together at the front thereof to form the front of the back pack 60. The ankle receiving compartments 68 and 70 are nested together in the front, that is, compartment 68 forms the front bottom of the back pack. Compartment 70 nests on the top of compartment 68 and forms the top front of the back pack 60. Preferably, compartment 68 is sewn to compartment 64 and to compartment 70. Preferably, compartment 70 is sewn to compartment 62. As a result, a compact back pack is formed.

Similar to the embodiments of FIGS. 1 through 7, the footwear compartments 62 and 64 form an interior compartment 66 therebetween preferably in the shape of an isosceles triangle. Desirably the triangle formed therebetween is an equilateral triangle. The angle $\alpha$ formed between the angularly joined footwear compartments 62 and 64 is from 30° to 90° preferably from 45° to 75° and most preferably about 60°. When the angle $\alpha$ is 60°, an equilateral triangle is formed between the angled footwear compartments 62 and 64. The interior compartment 66 is formed between the angularly joined footwear compartments 62 and 64 and a triangular floor is sewn or otherwise attached to the bottom of footwear compartments 62 and 64.

Desirably, the triangularly shaped central compartment 66 is a sufficient size for receipt of miscellaneous gear which may be associated with the heavy bulky footwear. Optionally, the area 66 may be sized sufficient to receive a roller skating helmet. Optionally, space 66 may be smaller and only sized to sufficiently receive pads or other miscellaneous items such as gloves or ski equipment. Optionally, a belt or strap can be provided on the front of the bag to hold a helmet. Shoulder straps 88 are attached to the back of the bag. Optionally, a cover can be provided to close off triangular interior compartment as shown in FIGS. 1 to 7.

The foregoing is considered an illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

I claim:

1. A backpack for carrying a pair of heavy bulky footwear comprising:

a) said backpack having a from and a back;

b) a first and second footwear compartment for holding said footwear; said footwear compartments having a predetermined size sufficient to receive one each of a pair of bulky heavy footwear; each said footwear compartment having a top and a bottom, the bottom of said first footwear compartment and the top of said second footwear compartment each having sufficient length to accommodate the height of said footwear;

c) said footwear compartments having a back waif and a front wall directly opposite of said back wall;

d) the back wall of said footwear compartments having a sufficient length to receive the sole of one of said heavy bulky footwear;

said first footwear compartment side wall having a length at the top of said first footwear compartment shorter than the length of the bottom of said first footwear compartment;

said bottom of said first footwear compartment forming a first ankle receiving compartment having a sufficient size to receive the ankle portion of said heavy bulky footwear;

said second footwear compartment having a second footwear compartment side wall;

said second footwear compartment side wail having a length at the bottom of said second footwear compartment shorter than the length of the top of said footwear compartment;

said top of said second footwear compartment forming a second ankle receiving compartment having a sufficient size to receive the ankle portion of said heavy bulky footwear;

e) said first and second footwear compartments being angularly joined together at the ankle receiving compartments to form a generally isosceles triangularly shaped space between said first and second footwear compartments;

f) said second ankle receiving compartment mounted on top of said first ankle receiving compartment to form the front of said backpack;

g) said front walls of said footwear compartments generally defining a portion of the front of said backpack;

h) means to enclose said isosceles triangularly shaped space formed between said first and second footwear compartments to form an interior compartment between said first and second footwear compartments.

2. A backpack according to claim 1 wherein said first and second footwear compartments have a narrow width for snugly securing said footwear in said left and right side footwear compartments.

3. A backpack according to claim 1 wherein said footwear is selected from the group consisting essentially of ski boots, riding boots, in-line roller skates, conventional roller skates and ice skates.

4. A backpack according to claim 1 wherein said footwear is a pair of in-line skates.

5. A backpack according to claim 1 wherein said isosceles triangularly shaped space is an equilateral triangularly shaped space.

6. A backpack according to claim 1 wherein said first and second footwear compartments are sewn together.

7. A backpack according to claim 1 wherein the angularly joined first and second footwear compartments form an angle $\alpha$ therebetween, said angle $\alpha$ being from about 30° to 90°.

8. A backpack according to claim 7 wherein the angle $\alpha$ formed between the first and second footwear compartments is 45° to 75°.

9. A backpack according to claim 7 wherein the angle $\alpha$ formed between the first and second footwear compartments is 30° to 60°.

10. A backpack according to claim 7 wherein the angle $\alpha$ formed between the first and second footwear compartments is 60°.

11. A backpack according to claim 10 wherein said footwear is a pair of in-line skates.

12. A backpack according to claim 11, further comprising, said first and second compartment's backwall having a height sufficient to snugly receive an in-line skate blade.

13. A backpack comprising:

a) a front and a back;

b) a left and right side compartment; said compartments having a predetermined size;

c) each said compartment having side walls, a bottom, a back wall and a front wall;

d) said left and right side compartments angularly joined together at the front of said backpack to form, with said back a generally isosceles .triangularly shaped space between the compartments;

e) said front walls of said compartments defining a portion of the front of said backpack;

f) means to enclose the generally isosceles triangularly shaped space formed between said left and right side compartments to form an interior compartment between the left and right side compartments.

14. The backpack according to claim 13 wherein said backpack is a backpack for carrying a pair of heavy bulky footwear; said predetermined size of said left and right side compartment is sufficient to receive one each of a pair of heavy bulky footwear.

* * * * *